US008465298B2

(12) United States Patent
Takeuchi et al.

(10) Patent No.: US 8,465,298 B2
(45) Date of Patent: Jun. 18, 2013

(54) BOARD-TO-BOARD CONNECTOR

(75) Inventors: Ryotaro Takeuchi, Yamato (JP); Toru Suzuki, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/140,868

(22) PCT Filed: Dec. 21, 2009

(86) PCT No.: PCT/US2009/068905

§ 371 (c)(1),
(2), (4) Date: Sep. 6, 2011

(87) PCT Pub. No.: WO2010/071869

PCT Pub. Date: Jun. 24, 2010

(65) Prior Publication Data

US 2011/0312221 A1 Dec. 22, 2011

(30) Foreign Application Priority Data

Dec. 19, 2008 (JP) ..... 2008-323181

(51) Int. Cl.
*H01R 12/00* (2006.01)

(52) U.S. Cl.
USPC ..... 439/74

(58) Field of Classification Search
USPC ..... 439/74
See application file for complete search history.

(56) References Cited

U.S. PATENT DOCUMENTS

| | | | | |
|---|---|---|---|---|
| 6,866,522 | B2 * | 3/2005 | Terashima et al. | 439/74 |
| 6,902,411 | B2 | 6/2005 | Kubo | |
| 7,195,494 | B2 * | 3/2007 | Ookura | 439/74 |
| 7,425,158 | B2 * | 9/2008 | Ookura | 439/660 |
| 7,484,969 | B2 | 2/2009 | Shiu | |
| 7,845,958 | B2 | 12/2010 | Hoshino et al. | |
| 8,083,527 | B2 * | 12/2011 | Takeuchi et al. | 439/65 |
| 2006/0051988 | A1 * | 3/2006 | Okura et al. | 439/74 |
| 2009/0176386 | A1 * | 7/2009 | Wu | 439/74 |

FOREIGN PATENT DOCUMENTS

| | | |
|---|---|---|
| JP | 3425692 B | 2/2001 |
| JP | 3564558 B | 8/2003 |
| JP | 4219308 | 3/2006 |
| JP | 2005-379020 | 12/2007 |
| JP | 2008-108688 | 11/2009 |

OTHER PUBLICATIONS

International Search Report and Written Opinion for PCT Patent Application No. PCT/US2009/0068905, dated Mar. 31, 2009.

* cited by examiner

*Primary Examiner* — Gary F. Paumen

(74) *Attorney, Agent, or Firm* — Timothy M. Morella

(57) ABSTRACT

A board-to-board connector comprises a first connector (1) and a second connector (101). The first connector has first terminals (61) and a first housing (11), which has a generally rectangular parallelepiped shape. The first housing is provided with concave insertion portions and first reinforcing brackets (51), which are arranged in the concave insertion portions. The second connector has second terminals (161) configured to make contact with the first terminals, and a second housing (111) which has a generally rectangular parallelepiped shape. The second housing is provided with convex insertion portions (122) configured to be inserted in the concave insertion portions, and second reinforcing brackets (151) arranged in the convex insertion portions and configured to engage with the first reinforcing brackets.

8 Claims, 7 Drawing Sheets

BOARD-TO-BOARD CONNECTOR

FIELD OF THE INVENTION

The present invention relates to a board-to-board connector.

DESCRIPTION OF THE RELATED ART

Hitherto, a board-to-board connector has been used for electrically connecting a pair of parallel circuit boards to each other. Such a board-to-board connector is attached, by fitting, to respective opposing surfaces of the pair of circuit boards so that they are electrically connected to each other. Moreover, a technique has already been proposed in which reinforcing brackets attached to both ends of a board-to-board connector are configured to function as a locking member so that a state of being engaged with a counterpart connector is maintained (reference should be made to, for example, Japanese Patent Application Laid-Open (Kokai) No. 2005-050702).

FIG. 7 is a cross-sectional view of reinforcing brackets of a board-to-board connector according to the prior art.

Referring to FIG. 7, a first housing designated by reference numeral 811 is a housing of a first connector mounted in a non-illustrated, first circuit board, and a second housing designated by reference numeral 911 is a housing of a second connector mounted in a non-illustrated, second circuit board. A plurality of first terminals 861 is mounted in the first housing 811, and a plurality of second terminals 961 is mounted in the second housing 911. When the first connector and the second connector are engaged together by fitting, corresponding ones of the first terminals 861 and the second terminals 961 are brought into contact with each other, so that the first circuit board and the second circuit board are electrically connected to each other.

Moreover, first reinforcing brackets 851 are attached to both left and right ends in the longitudinal direction (a direction perpendicular to the drawing sheet) of the first housing 811. Each of the first reinforcing brackets 851 is provided with a base portion 852, a fixed portion 856 which is configured to extend downward from the base portion 852 and is soldered to the first circuit board, a pair of latching arms 853 which is configured to extend upward from the base portion 852, and locking projections 854 which are formed at tip ends of the latching arms 853.

Similarly, second reinforcing brackets 951 are attached to both left and right ends in the longitudinal direction of the second housing 911. Each of the second reinforcing brackets 951 is provided with a base portion 952, a fixed portion 956 which is configured to extend upward from the base portion 952 and is soldered to the second circuit board, a pair of latching arms 953 which is configured to extend downward from the base portion 952, and locking projections 954 which are formed at tip ends of the latching arms 953.

When the first connector and the second connector are engaged together by fitting, the locking projections 854 of the first reinforcing brackets 851 are engaged with the locking projections 954 of the second reinforcing brackets 951. In this way, the first connector and the second connector are locked and their engagement state is maintained.

However, in the conventional board-to-board connector, since the latching arms 853 of the first reinforcing brackets 851 and the latching arms 953 of the second reinforcing brackets 951 have elastic properties, even when the locking projections 854 of the first reinforcing brackets 851 and the locking projections 954 of the second reinforcing brackets 951 are engaged with each other, the first connector and the second connector cannot be locked with a sufficiently large force. That is, when a removal force which is a force for releasing the engagement between the first connector and the second connector is applied to the first connector and/or the second connector, the latching arms 853 of the first reinforcing brackets 851 and/or the latching arms 953 of the second reinforcing brackets 951 are deformed elastically, so that the engagement between the locking projections 854 of the first reinforcing brackets 851 and the locking projections 954 of the second reinforcing brackets 951 is easily released. Therefore, even when the removal force is relatively small, the engagement between the first connector and the second connector is easily released.

SUMMARY OF THE INVENTION

Therefore, it is an object of the present invention to obviate the above-described problems encountered by the conventional board-to-board connector and to provide a board-to-board connector having such a configuration that one of first reinforcing bracket of a first connector and second reinforcing bracket of a second connector is formed of a large-width member, and the other is formed of a small-width member, so that a firm engagement state between the first reinforcing brackets and the second reinforcing brackets is achieved. As a result, a strong removal force is required for releasing the engagement state, and a stable engagement between the first connector and the second connector can be maintained. Accordingly, it is possible to provide good operability and high reliability for the board-to-board connector.

Therefore, in accordance with the present invention, a board-to-board connector is provided which comprises: a first connector having first terminals, a first housing which has a generally rectangular parallelepiped shape and is provided with concave insertion portions, and first reinforcing brackets which are arranged in the concave insertion portions; and a second connector having second terminals configured to make contact with the first terminals, a second housing which has a generally rectangular parallelepiped shape and is provided with convex insertion portions configured to be inserted in the concave insertion portions, and second reinforcing brackets which are arranged in the convex insertion portions and configured to be engaged with the first reinforcing brackets, wherein one of the first reinforcing bracket and the second reinforcing bracket is formed of a large-width member, and the other is formed of a small-width member.

In accordance with another embodiment of the present invention, the board-to-board connector has such a configuration that the any one of the first reinforcing brackets and the second reinforcing brackets being formed of the large-width member includes a folded portion which is formed by folding a thick plate having a large width twice.

In accordance with a further embodiment of the present invention, the board-to-board connector has such a configuration that each of the first reinforcing brackets is provided with a first protrusive locking portion; each of the second reinforcing brackets is provided with a second protrusive locking portion which is configured to be engaged with the first locking portion; the first locking portion has an outer surface, one half of which is configured as a curved surface having a small radius of curvature and the other half of which is configured as a curved surface having a larger radius of curvature or a sloped flat surface; and the second locking portion has an outer surface, one half of which is configured as a curved surface having a small radius of curvature, the other half of the outer surface being configured as a curved surface having a larger radius of curvature or a sloped flat surface, the one half and the other half being curved or sloped in the same direction.

In accordance with a still further embodiment of the present invention, the board-to-board connector has such a configuration that the concave insertion portions are formed at both ends in a longitudinal direction of the first housing; the first reinforcing brackets are arranged on both sides of each of the concave insertion portions; the convex insertion portions are formed at both ends in the longitudinal direction of the second housing; and the second reinforcing brackets are arranged in each of the convex insertion portions.

In accordance with a still further embodiment of the present invention, the board-to-board connector has such a configuration that each of the first reinforcing brackets is provided with a first connecting arm portion which is formed by folding a thick plate having a large width, and the first connecting arm portion is provided with a first locking portion which is formed in a bent portion.

In accordance with the present invention, the board-to-board connector has such a configuration that any one of the first reinforcing brackets of the first connector and the second reinforcing brackets of the second connector are formed of the large-width member, and the other reinforcing brackets are formed of the small-width member. Owing to such a configuration, a firm engagement state between the first reinforcing brackets and the second reinforcing brackets is achieved. As a result, a strong removal force is required for releasing the engagement state, and a stable engagement between the first connector and the second connector can be maintained. Accordingly, the board-to-board connector has good operability and high reliability.

DESCRIPTION OF THE PREFERRED EMBODIMENTS

Description of preferred embodiments of the present invention will be provided herein below in detail with reference to the accompanying drawings.

Figure 1:
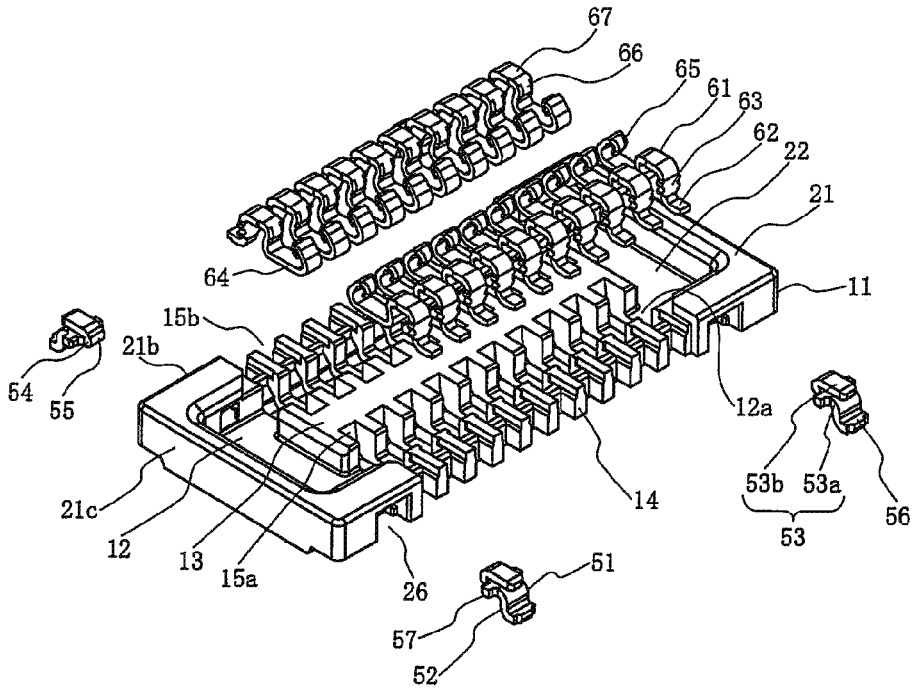
FIG. 1 is an exploded view of a first connector of a board-to-board connector according to an embodiment of the present invention, as viewed from a fitting face thereof.
Figure 2:
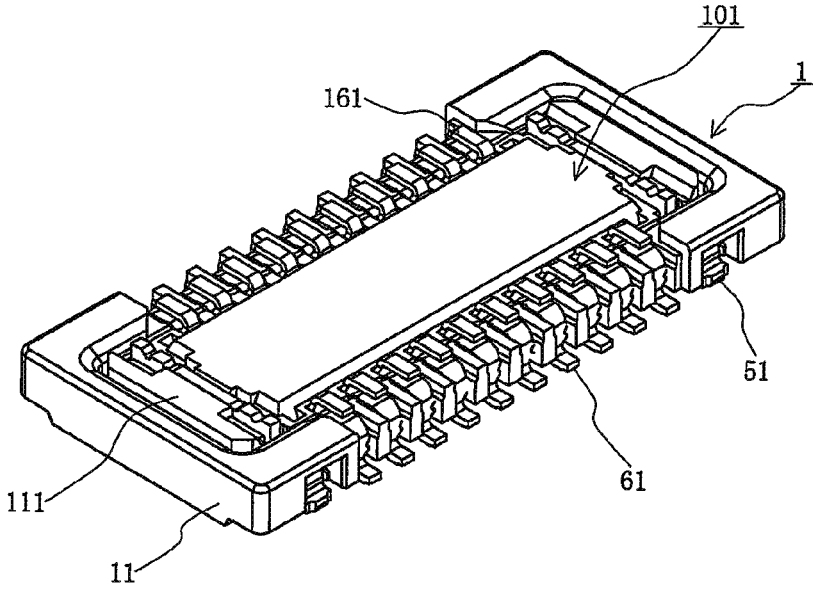
FIG. 2 is a perspective view of first and second connectors of the board-to-board connector according to the embodiment of the present invention, illustrating a state where the connectors are engaged together by fitting, as viewed from a fitting face of the first connector.
Figure 3:
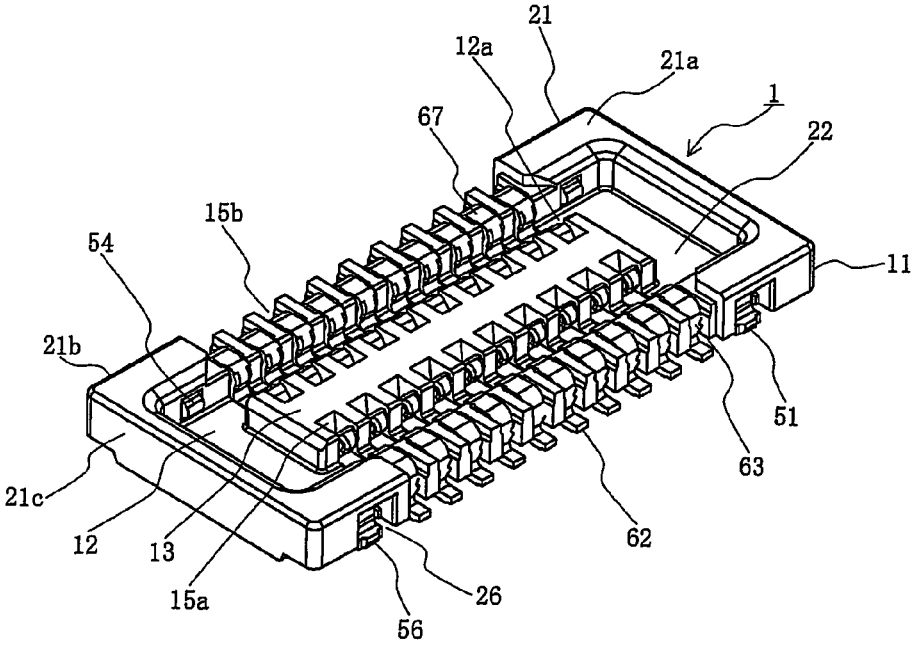
FIG. 3 is a perspective view of the first connector according to the embodiment of the present invention, as viewed from a fitting face thereof.

FIG. 1 is an exploded view of a first connector of a board-to-board connector according to an embodiment of the present invention, as viewed from a fitting face thereof; FIG. 2 is a perspective view of first and second connectors of the board-to-board connector according to the embodiment of the present invention, illustrating a state where the connectors are engaged together by fitting, as viewed from a fitting face of the first connector; FIG. 3 is a perspective view of the first connector according to the embodiment of the present invention, as viewed from a fitting face thereof.

In the drawing figures, a first connector, as one of a pair of board-to-board connectors according to the present embodiment, generally designated by reference numeral 1, is a surface-mounted type connector, which is mounted on a surface of a non-illustrated first board. Moreover, a second connector, as the other one of the pair of board-to-board connectors according to the present embodiment, generally designated by reference numeral 101, is a surface-mounted type connector, which is mounted on a surface of a non-illustrated second board. The board-to-board connector according to the present embodiment includes the first connector 1 and the second connector 101, and is configured to electrically connect the first board and the second board with each other. Here, the first board and the second board are for example printed circuit boards used in an electronic device or apparatus, and may be any type of board.

In addition, in the present embodiment, representations of directions such as up, down, left, right, front, rear, and the like, used for explaining the structure and movement of each part of the board-to-board connector, and the like, are not absolute, but relative. These representations are appropriate when each part of the board-to-board connector, and the like, is in the position shown in the drawing figures. If the position of the board-to-board connector, and the like, changes, however, it is assumed that these representations are to be changed according to a change in the position of the board-to-board connector, and the like.

The first connector 1 includes a first housing 11 as a connector body integrally formed of an insulating material such as synthetic resin. As will be understood from the drawing figures, the first housing 11 is a generally rectangular parallelepiped member having a generally rectangular, thick plate-like shape. A concave portion 12 having a generally rectangular shape having a surrounded perimeter is formed on a side, i.e., a fitting side (the upper side in FIG. 2), where the second connector 101 is fitted. The first connector 1 has a dimension of about 10.0 mm in length, about 2.5 mm in width, and about 1.0 mm in thickness, and the dimension may be appropriately changed. Moreover, a first protrusive convex portion 13 as an island portion is formed in the concave portion 12 to be integral with the first housing 11. Furthermore, side wall portions 14 configured to extend in parallel to the first protrusive convex portion 13 are formed at both sides of the first protrusive convex portion 13 to be integral with the first housing 11. In this case, the first protrusive convex portion 13 and the side wall portions 14 protrude upwardly from the bottom portion of the concave portion 12 and extend in the longitudinal direction of the first housing 11. Owing to this configuration, recessed groove portions 12*a*, as a portion of the concave portion 12, being elongated concave portions configured to extend in the longitudinal direction of the first housing 11 are formed at both sides of the first protrusive convex portion 13 to be disposed between the first protrusive convex portion 13 and the side wall portions 14. Although in the example illustrated in the drawing figures, the first protrusive convex portion 13 is singular in number, a plurality of first protrusive convex portions 13 may be provided and the number thereof is not particularly limited. In addition, the first protrusive convex portion 13 has a dimension of about 0.6 mm in width, for example, the dimension may be appropriately changed.

In this embodiment, first terminal-receiving inside cavities 15*a* having a recessed groove shape are formed on both side surfaces of the first protrusive convex portion 13. Moreover, first terminal-receiving outside cavities 15*b* having a recessed groove shape, respectively, are formed along an upper surface and both side surfaces of each of the side wall portion 14. Since the first terminal-receiving inside cavities 15*a* and the first terminal-receiving outside cavities 15*b* are connected with each other at a bottom portion of the recessed groove portion 12*a* and are integral with each other, the first terminal-receiving inside cavities 15*a* and the first terminal-receiving outside cavities 15*b* will be collectively referred to as first terminal receiving cavities 15.

The number of first terminal receiving cavities 15 on each side of the first protrusive convex portion 13 is 10 with a pitch of about 0.4 mm, for example. Moreover, the number of first terminals 61 received in the first terminal receiving cavities 15 on each side of the first protrusive convex portion 13 is 10 with a pitch of about 0.4 mm, for example. It should be appreciated that the pitch and the number of the first terminal receiving cavities 15 may be appropriately changed as required.

The first terminals 61 are an integral member formed, by applying e.g., punching and bending to a conductive metallic plate. Each of the first terminals 61 is provided with a holding portion 63, a tail portion 62 connected to a lower end of the holding portion 63, an upper connection portion 67 connected to an upper end of the holding portion 63, a second contact portion 66 formed in the vicinity of an inner end of the upper connection portion 67, a lower connection portion 64 connected to the second contact portion 66, and a first contact portion 65 formed in the vicinity of a free end of the lower connection portion 64.

The holding portions 63 are portions that extend in the up-down direction, i.e., in the thickness direction of the first housing 11 to be held by being fitted in the first terminal-receiving outside cavities 15*b*. The tail portions 62 are bent to be connected to the holding portions 63 and extend in the left-right direction, i.e., outwardly in the width direction of the first housing 11 to be connected to connection pads connected to a conductive trace on the first board by means of soldering or the like. The upper connection portions 67 are bent to be connected to the holding portions 63 and extend inwardly in the width direction of the first housing 11.

The second contact portions 66 having a curved shape and configured to downwardly bend and protrude toward the inner side in the width direction of the first housing 11 are formed at the inner ends of the upper connection portions 67. The lower connection portions 64 are portions which have a generally U shape in side view and are connected to the lower ends of the second contact portions 66. Furthermore, the first contact portions 65 having a curved shape and configured to bend in an U shape and outwardly protrude in the width direction of the first housing 11 are formed at the free ends, i.e., in the vicinity of the inner upper ends of the lower connection portions 64.

The first terminals 61 are fitted into the first terminal receiving cavities 15 from the fitting side to be fixedly secured to the first housing 11 when the holding portions 63 are clamped by the side walls of the first terminal-receiving outside cavities 15*b* in a sandwich manner, which are disposed outside the side wall portions 14. In this state, that is, a state where the first terminals 61 are mounted in the first housing 11, the first contact portions 65 and the second contact portions 66 are positioned on both left and right sides of the recessed groove portion 12*a* so as to oppose each other.

Since the first terminals 61 are an integral member formed by applying processing to a metal plate, they have some degree of elasticity. Moreover, as is obvious from the shape of the first terminals, the gap between the opposing ones of the first contact portions 65 and the second contact portions 66 is elastically changeable. That is, when the second terminals 161 of the second connector 101 are inserted to be positioned between the first contact portions 65 and the second contact portions 66, the gap between the first contact portions 65 and the second contact portions 66 is elastically increased.

Furthermore, first protrusive end portions 21 as a first fitting guide portion are arranged at both ends in the longitudinal direction of the first housing 11, respectively. A concave protrusive end portion 22 as a portion of the concave portion 12 is formed in each of the first protrusive end portions 21. The concave protrusive end portions 22 are generally rectangular concave portions and are connected to both ends in the longitudinal direction of each of the recessed groove portions 12*a*. Moreover, the concave protrusive end portion 22 functions as a concave insertion portion in which a later-described second protrusive end portion 122 of the second connector 101 is inserted in a state where the first connector 1 and the second connector 101 are engaged by fitting together.

Each of the first protrusive end portions 21 is provided with a flat upper surface 21*a* and sidewall extension portions 21*b* configured to extend in the longitudinal direction of the first housing 11 from both ends in the longitudinal direction of the side wall portion 14 and an end wall portion 21*c* configured to extend in the short-axis direction of the first housing 11 and having both ends thereof connected to the sidewall extension portions 21*b*. In each of the first protrusive end portions 21, the end wall portion 21*c* and the sidewall extension portions 21*b* connected to both ends of the end wall portion 21*c* form a continuous side wall having an inverted C shape to thereby define three sides of the rectangular concave protrusive end portion 22.

Furthermore, first reinforcing brackets 51 as a reinforcing bracket are attached to the first protrusive end portions 21. The first reinforcing brackets 51 are received and held in first concave bracket holding portions 26 formed in the sidewall extension portions 21*b*.

In the present embodiment, the first reinforcing brackets 51 are an integral member formed by applying processing, e.g., punching and bending, to a metal plate. Each of the first reinforcing brackets 51 is provided with a first body portion 52, a first board connection portion 56 which is connected to a lower end of the first body portion 52, a first connecting arm portion 53 which is connected to an upper end of the first body portion 52, a first locking portion 54 which is formed in the first connecting arm portion 53, and a first holding projection 57 which is formed in the first connecting arm portion 53.

The first body portion 52 is a thick plate-like portion that is configured to extend in the up-down direction, i.e., in the thickness direction of the first housing 11 and has a large width: that is, a dimension thereof in the longitudinal direction of the first housing 11 is large. Moreover, the first board connection portion 56 is configured to bend to be connected to the first body portion 52 and extend in the left-right direction, i.e., in a direction toward an outer side in the width direction of the first housing 11 to be connected to a fixing pad on the first board. Further, the first board connection portion 56 is also a thick plate-like portion which has approximately the same width as the first body portion 52.

The first connecting arm portion 53 is configured to bend to be connected to the first body portion 52 and extend toward an inner side in the width direction of the first housing 11. Moreover, the first connecting arm portion 53 is a folded portion having a shape formed by folding a thick plate having approximately the same width as the first body portion 52 twice, and a portion which is bent when the thick plate is folded, that is, the bent portion is the first locking portion 54. The first locking portion 54 is a portion of the first connecting arm portion 53 which protrudes outermost toward the inner side.

The first connecting arm portion 53 includes a lower half portion 53*a* which is positioned on the lower side and a upper half portion 53*b* which is positioned on the upper side, and the lower half portion 53*a* and the upper half portion 53*b* are connected with each other by the first locking portion 54. Moreover, the first holding projection 57 is configured to protrude in the longitudinal direction of the first housing 11 from either side face of the lower half portion 53*a*.

The first locking portion 54 has an outer surface which is a first locking surface 55 and is configured as a generally smooth convex surface. As will be described later, the first locking surface 55 includes a lower half face 55*a* which is positioned on the lower side and a upper half face 55*b* which is positioned on the upper side, the lower half face 55*a* is configured as a curved surface having a relatively small radius of curvature, and the upper half face 55*b* is configured as a curved surface having a radius of curvature larger than that of the lower half face 55*a* or a sloped flat surface. That is, when the radius of curvature of the lower half face 55*a* is defined as R1 and the radius of curvature of the upper half face 55*b* is defined as R2, respectively, a relation of R1<R2 is satisfied.

In a state where the first reinforcing brackets 51 are attached to the first protrusive end portions 21, almost the entire bodies thereof are received in the first concave bracket holding portions 26. On the other hand, in a state where at least portions of the first locking portions 54 protrude from the inner surfaces of the sidewall extension portions 21*b* to be received in the concave protrusive end portions 22 so that the first connector 1 and the second connector 101 are engaged by fitting together, the first reinforcing brackets 51 are engaged with later-described second reinforcing brackets 151 of the second connector 101.

Next, a description of the structure of the second connector 101 will now be provided herein below.

Figure 4:
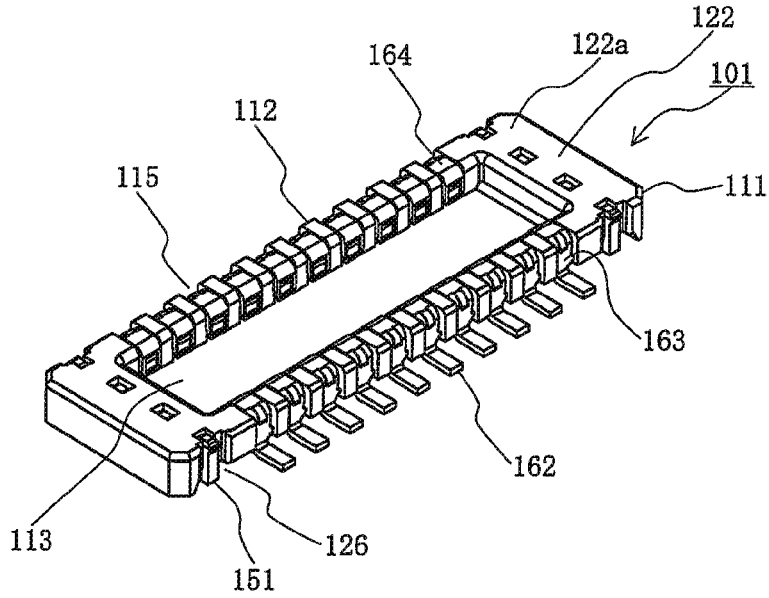
FIG. 4 is a perspective view of the second connector of the embodiment of the present invention, as viewed from a fitting face thereof.
Figure 5:
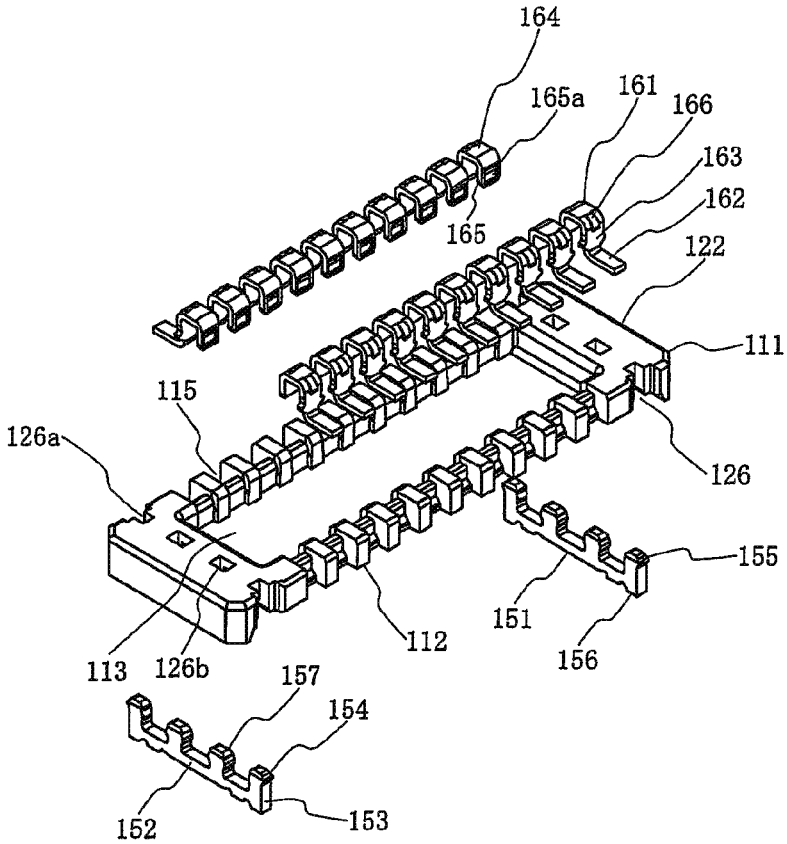
FIG. 5 is an exploded view of the second connector according to the embodiment of the present invention, as viewed from a fitting face thereof.

FIG. 4 is a perspective view of the second connector of the embodiment of the present invention, as viewed from a fitting face thereof; and FIG. 5 is an exploded view of the second connector according to the embodiment of the present invention, as viewed from a fitting face thereof.

The second connector 101 includes a second housing 111 as a connector body integrally formed of an insulating material such as synthetic resin. As will be understood from the drawing figure, the second housing 111 is a generally rectangular parallelepiped member having a generally rectangular, thick plate-like shape. The second housing 111 has a dimension of about 8.0 mm in length, about 1.5 mm in width, and about 0.8 mm in thickness, and the dimension may be appropriately changed as required. Moreover, an elongated recessed cavity portion 113 configured to extend in the longitudinal direction of the second housing 111 and second protrusive convex portions 112 as an elongated protrusive convex portion configured to define the outer sides of the recessed cavity portion 113 and extend in the longitudinal direction of the second housing 111 are integrally formed on a side, i.e., a fitting side (the upper side in FIGS. 4 and 5) of the second housing 111 where the first connector 1 is fitted. The second protrusive convex portions 112 are formed along both sides of the recessed cavity portion 113 and along both sides of the second housing 111. Moreover, second terminals 161 are arranged in each of the second protrusive convex portions 112.

As illustrated in the drawing figure, the recessed cavity portion 113 is closed by a bottom portion at a surface thereof on a side, i.e., a mounting surface (the lower surface in FIGS. 4 and 5) where it is mounted on the second board. Moreover, although in the example illustrated in the drawing figure, the number of second protrusive convex portions 112 is two, it may be singular in number and the number thereof is not particularly limited. The recessed cavity portion 113 has a dimension of about 0.7 mm in width, for example, and the dimension thereof may be appropriately changed as required.

Moreover, second terminal receiving cavities 115 are formed along both side surfaces and an upper surface of the second protrusive convex portion 112 so that the second terminals 161 are received in the second terminal receiving cavities 115. The number of second terminal receiving cavities 115 on each side of the recessed cavity portion 113 is 10 with a pitch of about 0.4 mm, for example. Moreover, the number of second terminals 161 received in the second terminal receiving cavities 115 on each side of the recessed cavity portion 113 is 10 with a pitch of about 0.4 mm, for example. It should be appreciated that the pitch and the number of the second terminal receiving cavities 115 may be appropriately changed as required.

The second terminals 161 are an integral member formed by applying processing, e.g., punching and bending to a conductive metal plate. Each of the second terminals 161 is provided with a holding portion 163 also functioning as a second contact portion, a tail portion 162 connected to a lower end of the holding portion 163, a connection portion 164 connected to an upper end of the holding portion 163, and a first contact portion 165 connected to an inner end of the connection portion 164.

The holding portions 163 are portions that extend in the up-down direction, i.e., in the thickness direction of the second housing 111 to be held by being fitted in the second terminal receiving cavities 115 and make contact with the second contact portions 66 of the first terminals 61. Moreover, the tail portions 162 are bent to be connected to the holding portions 163 and extend outwardly in the width direction of the second housing 111 to be connected to connection pads connected to a conductive trace on the second board by means of soldering or the like. The connection portions 164 are bent to be connected to the holding portions 163 and extend toward the inner side in the width direction of the second housing 111. The first contact portions 165 are portions that are bent to be connected to inner ends of the connection portions 164 and extend downwardly and make contact with the first contact portions 65 of the first terminals 61.

Furthermore, convex contact portions 166 configured to be engaged with the second contact portions 66 of the first terminals 61 are formed in the vicinity of the upper ends of the holding portions 163. Moreover, concave contact portions 165*a* configured to be engaged with the first contact portions 65 of the first terminals 61 are formed on the surface of the first contact portions 165.

Furthermore, second protrusive end portions 122 as a second fitting guide portion are arranged at both ends in the longitudinal direction of the second housing 111, respectively. Each of the second protrusive end portions 122 is a thick member that extends in the short-axis direction of the second housing 111 and has both ends thereof connected to both ends in the longitudinal direction of the second protrusive convex portion 112, and an upper surface 122*a* thereof is a generally rectangular flat surface. Moreover, the second protrusive end portions 122 function as convex insertion portions which are inserted in the concave protrusive end portions 22 of the first protrusive end portions 21 of the first connector 1 in a state where the first connector 1 and the second connector 101 are engaged by fitting together.

Furthermore, second reinforcing brackets 151 as a reinforcing bracket are attached to the second protrusive end portions 122. The second reinforcing brackets 151 are received and held in second concave bracket holding portions 126 formed in the second protrusive end portion 122. Each of the second concave bracket holding portions 126 is provided with a connecting arm accommodation-groove 126*a* which is formed at either end in the width direction of each of the second protrusive end portions 122 so as to extend in the up-down direction, and a holding projection receipt-hole 126*b* which is formed at an intermediate portion in the width direction of each of the second protrusive end portions 122 so as to extend in the up-down direction.

In the present embodiment, the second reinforcing brackets 151 are an integral member formed by applying processing, e.g., punching, to a metal plate. Each of the second reinforcing brackets 151 is provided with a second body portion 152, a second board connection portion 156 which is connected to a lower end of either extreme end in the longitudinal direction (the width direction of the second housing 111) of the second body portion 152, a second connecting arm portion 153 which is connected to an upper end of either extreme end in the longitudinal direction of the second body portion 152, a second locking portion 154 which is formed in the second connecting arm portion 153, and a second holding projection 157 which is connected to an upper end of an intermediate portion in the longitudinal direction of the second connecting arm portion 153.

The second body portion 152 is an elongated rod-shaped portion which has a small width: that is, a dimension thereof in the longitudinal direction of the second housing 111 is small, and which extends in the horizontal direction, i.e., in the width direction of the second housing 111. Moreover, the second body portion 152 has a width which is at least smaller than the width of the first body portion 52 of each of the first reinforcing brackets 51. Further, the second board connection portion 156 is connected to the second body portion 152 to be perpendicular to an extension direction thereof and extends in a downward direction, i.e., in a direction opposite to the fitting face of the second housing 111 to be connected to a fixing pad on the second board by means of soldering or the like. In addition, the second board connection portion 156 is also a small-width portion which has approximately the same width as the second body portion 152. The second connecting arm portion 153 is a strip-like portion which is connected to the second body portion 152 to be perpendicular to an extension direction thereof and extends in the upward direction, i.e., in a direction toward the fitting face of the second housing 111 to be received in each of the connecting arm accommodation-grooves 126*a*. Moreover, the second locking portion 154 is configured to protrude toward an outer side in the width direction of the second housing 111 from an upper end of the second connecting arm portion 153. Furthermore, the second connecting arm portion 153 and the second locking portion 154 are small-width portions which have substantially the same width as the second body portion 152, respectively.

The second locking portion 154 has an outer surface which is a second locking surface 155 and defines a lateral shape of the second locking portion 154 which is a downwardly bent, hook-shaped projection having a sharp tip end. As will be described later, the second locking surface 155 includes a lower half face 155*a* which is positioned on the lower side and a upper half face 155*b* which is positioned on the upper side, the lower half face 155*a* is configured as a curved surface having a relatively small radius of curvature, and the upper half face 155*b* is configured as a curved surface having a radius of curvature larger than that of the lower half face 155*a* or a sloped flat surface. That is, when the radius of curvature of the lower half face 155*a* is defined as R3 and the radius of curvature of the upper half face 155*b* is defined as R4, respectively, a relation of R3<R4 is satisfied. Moreover, the lower half face 155*a* and the upper half face 155*b* are curved or sloped in the same direction.

The second holding projection 157 is a rod-shaped portion which is connected to the second body portion 152 to be perpendicular to an extension direction thereof and extends in the upward direction, i.e., in a direction toward the fitting face of the second housing 111 to be pressed and held in each of the holding projection receipt-holes 126*b*. It is preferable that a projection having a shape capable of being squeezed into an inner wall of each of the holding projection receipt-holes 126*b* is formed on either side face of the second holding projection 157.

In a state where the second reinforcing brackets 151 are attached to the second protrusive end portions 122, almost the entire bodies thereof are received in the second concave bracket holding portions 126. On the other hand, in a state where the first connector 1 and the second connector 101 are engaged by fitting together, the second locking portion 154 is engaged with the first locking portion 54 of each of the first reinforcing brackets 51 of the first connector 1.

Next, a description of an operation of fitting the first connector 1 and the second connector 101 having the above-mentioned structure to be engaged with each other will now be provided herein below.

Figure 6:
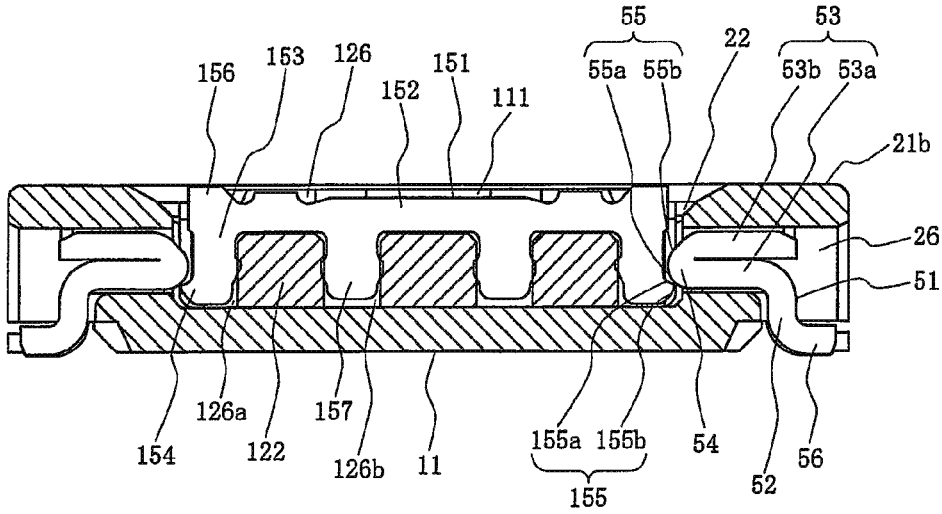
FIG. 6 is a cross-sectional view of the reinforcing brackets of the connectors according to the embodiment of the present invention, illustrating a state where the connectors are engaged together, by fitting.
Figure 7:
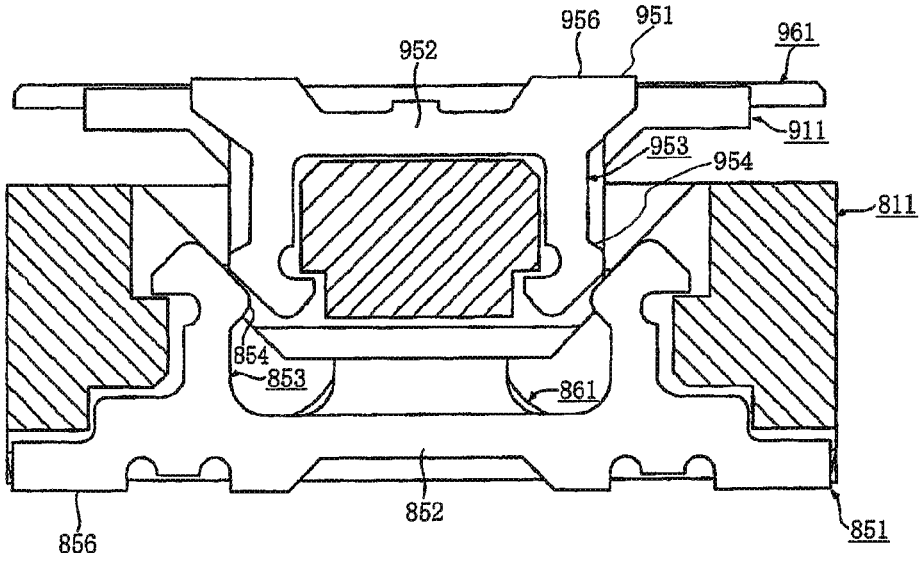
FIG. 7 PRIOR ART
FIG. 7 is a cross-sectional view of reinforcing brackets of a board-to-board connector according to the prior art.

FIG. 6 is a cross-sectional view of the reinforcing brackets of the connectors according to the embodiment of the present invention, illustrating a state where the connectors are engaged together, by fitting.

In this embodiment, the first connector 1 is assumed to be surface-mounted on the first board in a state where the tail portions 62 of the first terminals 61 are connected to a non-illustrated connection pads connected to a conductive trace on the first board by means of soldering or the like and the first board connection portions 56 of the first reinforcing brackets 51 are connected to the fixing pads on the first board by means of soldering or the like.

Similarly, the second connector 101 is assumed to be surface-mounted on the second board in a state where the tail portions 162 of the second terminals 161 are connected to the non-illustrated connection pads connected to a conductive trace on the second board by means of soldering or the like and the second board connection portions 156 of the second reinforcing brackets 151 are connected to the fixing pads on the second board by means of soldering or the like.

First, the operator manipulates the connectors so that the fitting face of the first connector 1 opposes the fitting face of the second connector 101. When the positions of the second protrusive convex portions 112 on the left and right sides of the second connector 101 correspond to the positions of the recessed groove portions 12*a* on the left and right sides of the first connector 1, the positioning between the first connector 1 and the second connector 101 is completed.

In such a state, when the operator moves the first connector 1 and/or the second connector 101 in a direction toward either one of the connectors, i.e., in the fitting direction, the second protrusive convex portions 112 on the left and right sides of the second connector 101 are received in the recessed groove portions 12*a* on the left and right sides of the first connector 1.

Moreover, the second terminals 161 of the second connector 101 are inserted to be positioned between the first contact portions 65 and the second contact portions 66 of the first terminals 61, so that the first contact portions 65 of the first terminals 61 are brought into contact with the first contact portions 165 of the second terminals 161, and the second contact portions 66 of the first terminals 61 are brought into contact with the holding portions 163 of the second terminals 161.

In this way, when the fitting engagement between the first connector 1 and the second connector 101 is completed, the first terminals 61 and the second terminals 161 are electrically connected to each other. Specifically, the first contact portions 65 of the first terminals 61 are engaged with the concave contact portions 165*a* of the second terminals 161, and the second contact portions 66 of the first terminals 61 are engaged with the convex contact portions 166 of the second terminals 161. As a result, the conductive trace connected to the connection pads on the first board being connected to the tail portions 62 of the first terminals 61 are electrically connected to the conductive trace connected to the connection pads on the second board being connected to the tail portions 162 of the second terminals 161. In this case, since the first terminals 61 and the second terminals 161 make multi-point contact with each other, it is possible to certainly maintain stable electrical connection.

Moreover, as illustrated in FIG. 6, the first reinforcing brackets 51 of the first connector 1 and the second reinforcing brackets 151 of the second connector 101 are locked by being engaged with each other. In this case, the second protrusive end portions 122 of the second connector 101 are inserted in the concave protrusive end portions 22 of the first connector 1, and the first locking portions 54 of the first reinforcing brackets 51 are engaged with the second locking portions 154 of the second reinforcing brackets 151, whereby the first connector 1 and the second connector 101 are locked.

Therefore, it is difficult to remove the second connector 101 from the first connector 1 even upon receipt of a force that releases the fitting engagement between the first connector 1 and the second connector 101, that is, upon receipt of a removal force for removing the second connector 101 from the first connector 1. That is, a necessary removal force is increased.

As described above, the first locking surface 55 which is the outer surface of each of the first locking portions 54 includes the lower half face 55*a* which is positioned on the lower side and the upper half face 55*b* which is positioned on the upper side, the lower half face 55*a* is configured as a curved surface having a relatively small radius of curvature, and the upper half face 55*b* is configured as a curved surface having a radius of curvature larger than that of the lower half face 55*a* or a sloped flat surface. On the other hand, the second locking surface 155 which is the outer surface of each of the second locking portions 154 includes the lower half face 155*a* which is positioned on the lower side (the upper side in the position and attitude illustrated in FIG. 6) and a upper half face 155*b* which is positioned on the upper side (the lower side in the position and attitude illustrated in FIG. 6), the lower half face 155*a* is configured as a curved surface having a relatively small radius of curvature, and the upper half face 155*b* is configured as a curved surface having a radius of curvature larger than that of the lower half face 155*a* or a sloped flat surface.

Therefore, in a step of fitting the first connector 1 and the second connector 101 to be engaged with each other, when the second locking portions 154 pass the first locking portions 54 in a direction from up to down in FIG. 6 while making contact with the first locking portions 54 and passing therethrough, the upper half faces 155*b* which are curved surfaces having a large radius of curvature or sloped flat surfaces are moved in a direction from up to down along the upper half faces 55*b* which are curved surfaces having a large radius of curvature or sloped flat surfaces. Therefore, the second locking portions 154 can be smoothly moved in a direction from up to down while making contact with the first locking portions 54, thereby reaching positions located on the lower side of the first locking portions 54 as illustrated in FIG. 6. Accordingly, it is possible to prevent an insertion force needed when the first connector 1 and the second connector 101 are engaged by fitting together from increasing excessively.

On the other hand, in a step of releasing the engagement between the first connector 1 and the second connector 101, i.e., removing the second connector 101 from the first connector 1, when the second locking portions 154 pass the first locking portions 54 in a direction from down to up in FIG. 6 while making contact with the first locking portions 54, the lower half faces 155*a* which are curved surfaces having a small radius of curvature are moved in a direction from down to up along the lower half faces 55*a* which are small curved surfaces having a large radius of curvature. Furthermore, the lower half faces 155*a* are curved or sloped in the same direction as the upper half faces 155*b*, and the second locking portions 154 are configured as hook-shaped projections which are bent downward (upward in the position and attitude illustrated in FIG. 6) and have sharp tip ends. Therefore, the second locking portions 154 are caught on the first locking portions 54, and it is thus difficult for the second locking portions 154 to move upward from the positions located on the lower side of the first locking portions 54 as illustrated in FIG. 6. Accordingly, a strong removal force is required for releasing the engagement between the first connector 1 and the second connector 101, and thus, a stable engagement between the first connector 1 and the second connector 101 can be achieved.

The first connecting arm portions 53 are configured as members having a shape formed by folding a thick plate having a large width twice, and the folded portions are the first locking portions 54. Therefore, even when the first locking portions 54 receive an upward biasing force from the second locking portions 154 in the course of removing the second connector 101 from the first connector 1, the first connecting arm portions 53 are hardly deformed in the upward direction. Therefore, since the first locking portions 54 are not displaced, a strong removal force is required for releasing the engagement between the first connector 1 and the second connector 101, so that a stable engagement between the first connector 1 and the second connector 101 can be achieved.

Furthermore, although the second connecting arm portions 153 are small-width members, since the second connecting arm portions 153 are strip-like members of which the dimension in the width direction of the second housing 111 is larger than the dimension in the longitudinal direction of the second housing 111, they have high rigidity in the width direction of the second housing 111. Further, bottom walls of the connecting arm accommodation-grooves 126*a* are positioned on a side of the second connecting arm portions 153 opposite to the second locking portions 154. Therefore, even when the second locking portions 154 receive a downward biasing force from the first locking portions 54 in the course of removing the second connector 101 from the first connector 1, the second connecting arm portions 153 are hardly deformed in a direction toward the inner side in the width direction of the second housing 111. Accordingly, since the second locking portions 154 are not displaced, a strong removal force is required for releasing the engagement between the first connector 1 and the second connector 101, so that a stable engagement between the first connector 1 and the second connector 101 can be achieved.

As illustrated in FIGS. 3 and 4, in the present embodiment, the first housing 11 having a generally rectangular thick plate-like shape is formed with a total of four first reinforcing brackets 51 at positions located in the vicinity of four corners thereof. Similarly, the second housing 111 having a generally rectangular thick plate-like shape is formed with a total of four second connecting arm portions 153 at positions located in the vicinity of four corners thereof. Therefore, when the first locking portions 54 and the second locking portions 154 are engaged with each other at four positions located in the vicinity of these respective corners, the first connector 1 and the second connector 101 are locked. Furthermore, the engagement between the first locking portions 54 and the second locking portions 154 in the above-mentioned four positions is extremely firm as described above, and a strong removal force is required for releasing the engagement.

That is, any of the lock states between the first reinforcing brackets 51 and the second reinforcing brackets 151 in the above-mentioned four positions is firm, and neither of the lock states is weak. Therefore, it is possible to prevent occurrence of a so-called oblique removal phenomenon in which when the engagement between the first connector 1 and the second connector 101 is released so that the second connector 101 is removed from the first connector 1, the lock states are gradually released from position where the lock state is weak, and thus the engagement state between the first connector 1 and the second connector 101 is tilted. Therefore, when the engagement between the first connector 1 and the second connector 101 is released, it is necessary to release the lock states between the first reinforcing brackets 51 and the second reinforcing brackets 151 in the above-described four positions substantially at the same time. Accordingly, a further stronger removal force is required, and thus a further stable engagement between the first connector 1 and the second connector 101 can be achieved.

In the example illustrated in FIG. 6, even in a state where the first reinforcing brackets 51 and the second reinforcing brackets 151 are engaged with each other, the tip ends of the first locking portions 54 are spaced apart from the second connecting arm portions 153. However, the positional relationship between the first reinforcing brackets 51 and the second reinforcing brackets 151 may be set such that the tip ends of the first locking portions 54 are brought into abutting contact with the second connecting arm portions 153 in a state where the first reinforcing brackets 51 and the second reinforcing brackets 151 are locked by being engaged with each other.

Although it has been described that the first connecting arm portions 53 and the second connecting arm portions 153 are hardly deformed, it is obvious that they will be deformed to some extent upon receipt of a strong force of a certain level or more. Therefore, the operator is able to perform an operation for engagement and/or disengagement between the first connector 1 and the second connector 101 by exerting a strong force of a certain level or more.

Further, although it has been described with respect to an example where the first reinforcing brackets 51 are formed of a large-width member and the second reinforcing brackets 151 are formed of a small-width member, the first reinforcing brackets 51 may be formed of a small-width member and the second reinforcing brackets 151 may be formed of a large-width member.

As described above, in the present embodiment, one of the first reinforcing bracket 51 of the first connector 1 and the second reinforcing bracket 151 of the second connector 101 is formed of a large-width member, and the other is formed of a small-width member. Owing to such a configuration, a firm engagement state between the first reinforcing brackets 51 and the second reinforcing brackets 151 can be achieved. As a result, a strong removal force is required for releasing the engagement state, and a stable engagement between the first connector 1 and the second connector 101 can be maintained. Accordingly, it is possible to provide good operability and high reliability for the board-to-board connector.

Moreover, in the present embodiment, the any one of the first reinforcing brackets 51 and the second reinforcing brackets 151 being formed of the large-width member includes a folded portion which is formed by folding a thick plate having a large width twice. Owing to such a configuration, any one of the first reinforcing brackets 51 and the second reinforcing brackets 151 can have a high rigidity in a plate thickness direction. Therefore, a firm engagement state between the first reinforcing brackets 51 and the second reinforcing brackets 151 can be achieved. Accordingly, a strong removal force is required for releasing the engagement state.

Furthermore, in the present embodiment, each of the first reinforcing brackets 51 is provided with the first protrusive locking portion 54; each of the second reinforcing brackets 151 is provided with the second protrusive locking portion 154 which is configured to be engaged with the first locking portion 54; the first locking portion 54 has the first locking surface 55, the lower half face 55*a* of which is configured as a curved surface having a small radius of curvature and the upper half face 55*b* of the first locking surface 55 being configured as a curved surface having a larger radius of curvature or a sloped flat surface; and the second locking portion 154 has the second locking surface 155, the lower half face 155*a* of which is configured as a curved surface having a small radius of curvature, the upper half face 155*b* of the second locking surface 155 being configured as a curved surface having a larger radius of curvature or a sloped flat surface, the lower half face 155*a* and the upper half face 155*b* being curved or sloped in the same direction. Owing to such a configuration, when the first connector 1 and the second connector 101 are engaged by fitting together, it is possible to prevent an insertion force needed when the first connector 1 and the second connector 101 are engaged by fitting together from increasing excessively. Moreover, a strong removal force is needed when the engagement between the first connector 1 and the second connector 101 is released.

Furthermore, in the present embodiment, the concave protrusive end portions 22 are formed at both ends in the longitudinal direction of the first housing 11; the first reinforcing brackets 51 are arranged on both sides of each of the concave protrusive end portions 22; the second protrusive end portions 122 are formed at both ends in the longitudinal direction of the second housing 111; and the second reinforcing brackets 151 are arranged in each of the second protrusive end portions 122. Owing to such a configuration, the first reinforcing brackets 51 and the second reinforcing brackets 151 are engaged in four positions, so that any of the lock states between the first reinforcing brackets 51 and the second reinforcing brackets 151 in the above-mentioned four positions is firm. Therefore, a strong removal force is required for releasing the engagement states, and thus the oblique removal phenomenon might not occur. Therefore, when the engagement between the first connector 1 and the second connector 101 is released, it is necessary to release the lock states between the first reinforcing brackets 51 and the second reinforcing brackets 151 in the above-described four positions substantially at the same time. Accordingly, a further stronger removal force is required, and thus a further stable engagement between the first connector 1 and the second connector 101 can be achieved.

Furthermore, each of the first reinforcing brackets 51 is provided with the first connecting arm portion 53 which is formed by folding a thick plate having a large width, and the first connecting arm portion 53 is provided with the first locking portion 54 formed in the bent portion. Owing to such a configuration, the first connecting arm portion 53 has a high rigidity, and the first locking portion 54 is not displaced. Therefore, a strong removal force is required for releasing the engagement between the first connector 1 and the second connector 101.

The present invention is not limited to the above-described embodiments, and may be changed or modified in various ways based on the gist of the present invention, and these changes and modification are not eliminated from the scope of the present invention as claimed in the attached claims.

What is claimed is:

1. A board-to-board connector comprising:

a first connector, the first connector including first terminals, a first housing having a generally rectangular parallelepiped shape and provided with concave insertion portions, and first reinforcing brackets arranged in the concave insertion portions, each first reinforcing bracket being provided with a first protrusive locking portion, the first locking portion having an outer surface, one half of which is configured as a curved surface having a small radius of curvature, and the other half being configured as a curved surface having a larger radius of curvature or a sloped flat surface; and a second connector, the second connector including second terminals configured to make contact with the first terminals, a second housing having a generally rectangular parallelepiped shape and provided with convex insertion portions configured fit within the concave insertion portions, and second reinforcing brackets arranged in the convex insertion portions and configured to engage the first reinforcing brackets, each second reinforcing bracket being provided with a second protrusive locking portion configured to engage the first locking portion, the second locking portion having an outer surface, one half of which is configured as a curved surface having a small radius of curvature, and the other half being configured as a curved surface having a larger radius of curvature or a sloped flat surface, both halves being curved or sloped in the same direction;

wherein one of the first reinforcing bracket and the second reinforcing bracket is formed of a large-width member, and the other is formed of a small-width member.

2. The board-to-board connector of claim 1, wherein the reinforcing brackets formed of the large-width member include a folded portion formed by folding a thick plate having a large width twice.

3. The board-to-board connector of claim 1, wherein the concave insertion portions are formed at both ends in a longitudinal direction of the first housing.

4. The board-to-board connector of claim 1, wherein each first reinforcing bracket is provided with a first connecting arm portion formed by folding a thick plate having a large width.

5. The board-to-board connector of claim 3, wherein the first reinforcing brackets are arranged on both sides of each concave insertion portion.

6. The board-to-board connector of claim 5, wherein the convex insertion portions are formed at both ends in the longitudinal direction of the second housing.

7. The board-to-board connector of claim 6, wherein the second reinforcing brackets are arranged in each convex insertion portion.

8. The board-to-board connector of claim 4, wherein the first connecting arm portion is provided with a first locking portion formed in a bent portion.

* * * * *